United States Patent [19]

Moreinis-Eisen

[11] 4,081,976

[45] Apr. 4, 1978

[54] EQUIPMENT FOR THE TREATMENT OF TEXTILES IN THE FORM OF HANKS OR WEBS WITH LIQUID OR PASTES

[76] Inventor: David Moreinis-Eisen, Apartado Aereo 4897, Bogota d.E., Colombia

[21] Appl. No.: 773,641

[22] Filed: Mar. 2, 1977

Related U.S. Application Data

[63] Continuation of Ser. No. 594,990, Jul. 11, 1975, abandoned.

[51] Int. Cl.[2] ..... D06B 3/20

[52] U.S. Cl. ..... 68/19; 68/175; 68/177; 118/53

[58] Field of Search ..... 68/175–179, 68/5 C, 19, 23 R, 212; 118/52, 53, 56

[56] References Cited

U.S. PATENT DOCUMENTS

| | | | |
|---|---|---|---|
| 1,825,478 | 9/1931 | Rowley et al. | 68/178 X |
| 2,321,635 | 6/1943 | Taylor | 68/175 X |
| 3,330,134 | 7/1967 | Carpenter | 68/178 X |
| 3,834,194 | 9/1974 | Stanway | 68/176 |

FOREIGN PATENT DOCUMENTS

| | | | |
|---|---|---|---|
| 478,300 | 2/1953 | Italy | 68/177 |

*Primary Examiner*—Philip R. Coe

*Attorney, Agent, or Firm*—Ladas, Parry, Von Gehr, Goldsmith & Deschamps

[57] ABSTRACT

An equipment for treating textiles in the form of hanks or webs comprising at least one drive member coupled to the said hank or web, at least one applicator device which contains the liquid or paste to be applied to the hank or web, guide members which guide the hank or web through the said liquid or paste, and at least two centrifuging elements located in the path of the hank or web and mounted for rotation, wherein the wrap-around angle of the hank or web on each centrifuging element is at least 90°, the arrangement being uniformly to distribute the liquid or paste, applied to the hank or web, over the hank or web cross-section, in the wrap-around zone of the centrifuging elements, under the influence of the pressure on the centrifuging elements and the centrifugal force, generated by these, and and to centrifuge off the excess liquid or paste.

6 Claims, 2 Drawing Figures

EQUIPMENT FOR THE TREATMENT OF TEXTILES IN THE FORM OF HANKS OR WEBS WITH LIQUID OR PASTES

This is a continuation, of application Ser. No. 594,990 filed 7/11/75, and now abandoned.

The present invention relates to a process for the treatment of textiles, such as yarns, in the form of hanks or webs, with liquids or pastes, and to equipment which serves for carrying out this process, it being possible to carry out the treatment in accordance with the concentrated liquor foam process which in recent times has become known by the name of "Sancowat process." This process is described, for example, in DOS 2,145,827 and 2,243,865. The process according to the invention can be used, for example, for dyeing, softening, application of various finishes and washing.

As is known, piece goods are in general dyed by the festoon system. In this, the goods to be dyed are festooned over a series of parallel rods in a container (beck) through which the liquor flows.

A special embodiment of such an apparatus is the winch beck, which essentially consists of a large beck over which a roll (winch) is mounted. The goods to be dyed are twisted into a hose-like shape and passed over the roll, the lower part of the revolving goods to be dyed always dipping into the liquor.

Thus, for example, Britist patent specification No. 1,088,665 shows a winch beck with a screw-like guide member, with one end of the hank to be treated being fixed to a conveyor device and the hank being drawn over the screw-shaped guide member.

These piece dyeing apparatuses and hank dyeing apparatuses, and similar apparatuses, that is to say apparatuses working on the same principle, suffer from the disadvantage that they require relatively large amounts of water since the liquor can quite easily occupy a volume of 2 to 3 $m^3$. Furthermore, it is not possible to subject the piece goods or hank goods to a pre-drying on the known apparatuses.

The present invention is intended to overcome these disadvantages. The process which forms the subject of this invention is characterised in that the hank or the web is passed over at least one drive member, through an applicator device for a liquid or paste, especially a solution or dispersion of a dyestuff or of a detergent, and over at least two centrifuging elements which are mounted capable of rotation, at a distance from one another and in series, and is at the same time deflected from its path, in order that the liquid or paste applied to the hank or the web is uniformly distributed over the cross-section of the hank or web, in the circumferential zone of each centrifuging element, under the influence of the pressure of the centrifuging elements and of the centrifugal force, and the excess liquid or paste is centrifuged off.

Preferably, the hank or the web is passed, in time sequence, over the drive member, the applicator device and the centrifuging elements, with the individual centrifuging elements rotating at different circumferential speeds.

The process is advantageously carried out in a closed housing and moisture can be supplied to the hank or the web by means of steam.

The equipment which serves to carry out this process is characterised, according to the invention, by at least one drive member coupled to the said hank or the said web, at least one applicator device which contains the liquid or paste to be applied to the hank or the web, guide members which guide the hank or the web through the said substance, and at least two centrifuging elements which are located in the path of the hank or of the web and are mounted so that they can rotate; in addition, the wrap-round angle of the hank or of the web against each centrifuging element is at least 90°, and the purpose of the whole arrangement is uniformly to distribute the liquid or paste, applied to the hank or the web, over the hank cross-section or web cross-section, in the circumferential zone of this centrifuging element, under the influence of the pressure of the centrifuging elements and the centrifugal force, and to centrifuge off the excess liquid or paste.

The centrifuging elements are preferably driven by a shared drive element, for example a drive belt, but are of different circumferential lengths. Preferably, the centrifuging elements are constructed as cylindrical rollers of different diameter, and according to a special embodiment the diameters of the centrifuging rollers decrease in the direction of travel of the hank or of the web.

The shared drive element of the centrifuging rollers can be coupled to the said drive member via a transmission member, for example an endless chain.

According to a preferred embodiment of this equipment, the average circumferential speed of the centrifuging elements is at least $3L/n$ (meters per minute), wherein L is the hank length or web length, in *m*, present on the device, and *n* is the number of centrifuging elements.

The attached drawing illustrates an example of an embodiment of equipment used to carry out the process according to the invention.

Figure 1:
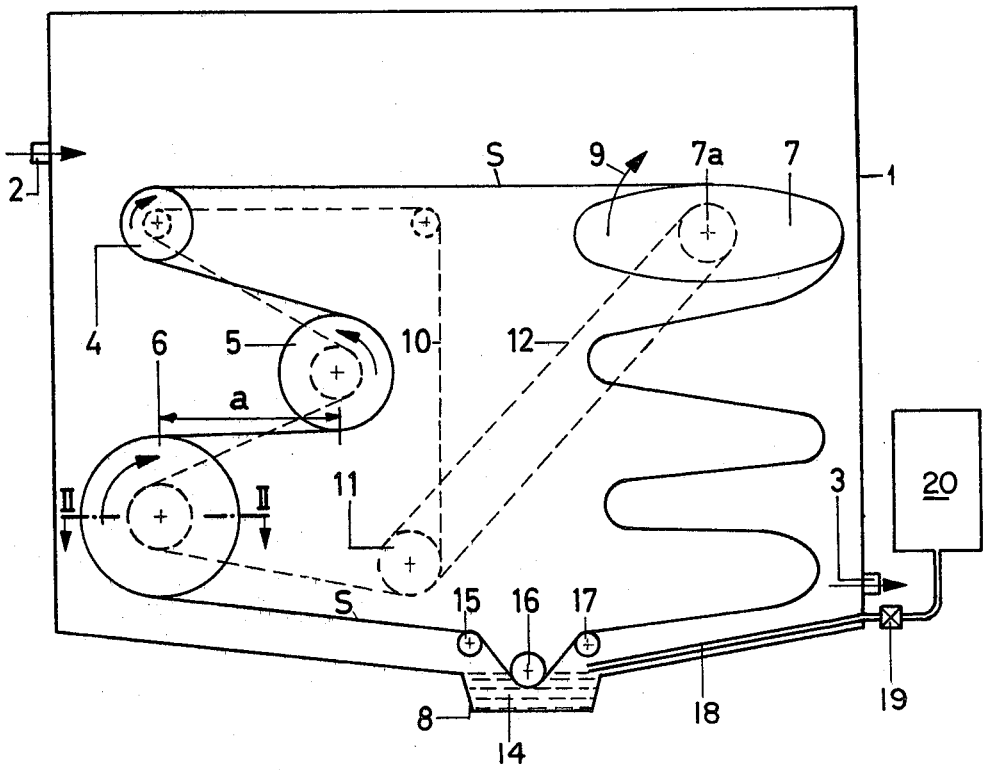
FIG. 1 is a schematic cross-section of such equipment.

The equipment shown schematically in FIG. 1, whilst dispensing with unimportant details, has a pressure-tight housing 1, provided with an inlet pipe 2 and an outlet pipe 3 for hot air and/or steam.

Three parallel centrifuging rollers 4, 5 and 6 are located within the housing 1, and a hank or a web, S, which is to be treated is passed over their cylindrical circumferential surfaces. This hank or this web S furthermore passes a drive roller 7 and a liquid applicator device 8, for example a dyeing equipment.

The drive roller 7 which rotates in the sense of the arrow 9 and is provided with a drive motor *7a* draws the hank or the web S from the last centrifuging roller 4 and deposits it, by virtue of the oval cross-section of the drive roller, in loops in a downward direction. The drive of the centrifuging rollers 4, 5 and 6 is provided by a shared drive belt 10, the belt pulley 11 of which is coupled via an endless chain 12 to the axle of the drive roller 7.

Figure 2:
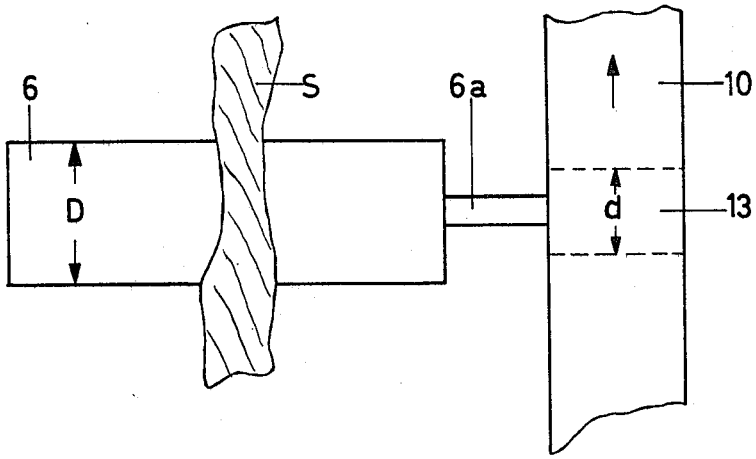
FIG. 2 is a diagrammatic partial section in plan along section line II—II in FIG. 1.

The construction of the centrifuging rollers is shown for the example of the centrifuging roller 6 in FIG. 2. The centrifuging roller 6 has a coaxial trunnion *6a*, to which a service pulley 13 is fixed so that it cannot rotate independently. Preferably, the trunnion *6a*, is detachably anchored in the hub of the centrifuging roller, by known means. The drive belt 10 passes over the service pulley 13 of the centrifuging roller 6 in such a way that its wrap-round angle is about 160°, but at least 90°. This condition applies to all centrifuging rollers used. As a result, the centrifuging rollers 4, 5 and 6 are also caused to rotate, and do so at a circumferental speed inversely proportional to the diameter *d* of th belt pulley 13 and directly proportional to the diameter D of the centrifuging roller. As a result of choosing a large wrap-round angle, the hank or the web remains for a relatively long time on the circumference of each centrifuging roller and thus a longer period of action of the centrifugal force is achieved.

By appropriately choosing the drive speed of the belt pulley 11 and the two diameters *d* and D it is thus possible to reach a situation where the hank or the web undergoes a relaxation in the intermediate zone between two adjacent centrifuging rollers 6/5 or 5/4.

In the illustrative embodiment shown, the hank or the web S is passed through a dyestuff solution or a dyestuff dispersion 14, being guided by three guide rollers 15, 16 and 17 in the region of the applicator device 8. Here, the hank or the web S picks up dyestuff solution or dyestuff dispersion over its circumferential surface and this solution or dispersion is then uniformly distributed over the hank cross-section or web cross-section when the hank or web passes through the centrifuging rollers 6, 5 and 4. In contrast to all previously known processes, this uniform distribution is achieved in particular through the centrifuging rollers rotating at relatively high circumferential speed and through both the roller pressure and the centrifugal force acting on the hank or the web on the circumference of the centrifuging rollers. As a result of the combined action of these two forces, the dyestuff solution or dyestuff dispersion evenly penetrates the hank or the web, the radial orientation of which, after all, changes constantly. The number of passes through the centrifuging rollers or the duration of the dyeing process carried out at high speeds of revolution depends of course on the hank material or web material and the dyestuff used, but in any case the hank or the web can be observed through an inspection window. As soon as uniform distribution of the dyestuff in the hank cross-section or web cross-section has been achieved, the drive speed of the motor 7*a* can be reduced, after which the dyestuffs can be fixed.

The fixing of the dyestuffs can take place according to one of the known processes with steam and/or hot air or by means of suitable chemicals. In the example shown, steam enters the housing 1 at 2 and leaves it through the outlet pipe 3.

As a result of the balancing of the hank tension or web tension and the circumferential speed at the centrifuging rollers 4, 5 and 6, a proper pumping action results as the hank or the web passes through, since the hank or the web is alternately pressed against the circumference of the particular centrifuging roller and is again stretched in the region intermediate between two centrifuging rollers. As a result of this "breathing process" perfect dyestuff distribution is ensured. The centrifugal force, for its part, contributes to the fact that dyestuff particles in each case pass radially through the hank in an outward direction whilst the excess of dyestuff solution or dyestuff dispersion is centrifuged off and hence a degree of pre-drying is already achieved.

Preferably, a little steam is passed continuously into the housing in order to keep the hank or the web moist.

The applicator device 8 is preferably filled, with concentrated dyestuff solution or dyestuff dispersion, via a pipeline 18 which is provided with a shut-off valve 19 and is connected to a container 20. The desired dyestuff solution or dyestuff dispersion is filled into the container 17 before beginning operation.

The speeds of the centrifuging rollers are so chosen that the combined action of the roller pressure and the centrifugal force results in optimum distribution of the dyestuff. When using three centrifuging rollers it has proved very advantageous if the mean speed of the hank or of the web, in meters/minute, corresponds numerically approximately to the total length of the hank or of the web in meters. Hence, the optimum hank speed is given by $$v = 3L/n,$$

wherein L is the hank length or web length in the device and *n* is the number of centrifuging rollers used.

Preferably, the circumferential speed of the last centrifuging roller 4 is kept somewhat above the circumferential speed of the drive roller 7. For example, if the centrifuging roller 4 rotates at a circumferential speed of approx. 106 m/minute, the drive roller should rotate at approx. 100 m/minute.

Furthermore, the hank speed or web speed of course also depends on the nature of the hank material or the web material, the nature of the dyestuff solution or dystuff dispersion (especially its affinity) and the desired distribution of the dyestuff solution or the dyestuff dispersion over the hank cross-section or web cross-section.

In the equipment described, the centrifuging roller plays a particularly important part. Whilst the previously known processes and equipment only employ a guide roller or squeeze roller, a completely new function appears in the equipment described, by virtue of which function a uniform distribution of liquid and dyestuff whilst using minimum amounts of water, and at the same time a pre-drying by centrifuging, are achieved. The centrifuging rollers 4, 5 and 6, however, do not have to be of cylindrical construction but could optionally also have a triangular cross-section or any other appropriate cross-section. It would also be possible to manufacture the centrifuging rollers from stainless steel rods which would, for example, be located over the circumference of an imaginary cylinder and would be held together at their end faces by means of steel discs.

The drive belt 10 can, in a variant, also be passes directly over the cylindrical roller body of the centrifuging roller 6.

According to a preferred embodiment, the circumferential speeds of the rollers 6, 5 and 4 decrease in progression, so that the roller 6 has the highest circumferential speed and the roller 4 has the lowest circumferential speed.

Since at any time only a fraction of the total hank length or web length is being treated, the equipment described requires a very low motor rating compared to the known installations.

The oval shape of the drive roller 7 according to FIG. 1 is preferred since in that case the hank or the web is laid down in loop form, but another cross-section shape could also be chosen for the drive roller 7. The drive roller 7, again, can consist, for example, of steel rods which are arranged about the circumference of an imaginary cylinder.

Instead of the applicator device 8 according to FIG. 1, it would also be possible to use an adjustable spray device which sprays the liquid, for example the dyestuff solution or dyestuff dispersion, in the desired amount, onto the hank or onto the web.

The illustrative embodiment described in relation to FIG. 1 and 2 has hitherto only been discussed in connection with the application of a dyestuff solution or dyestuff dispersion onto the hank or the web S. In principle, however, the equipment described can also be used for washing piece goods or hanks of yarn. In that case, the hank or the web S is passed, in a first phase, at moderate speed through the applicator device 8 filled with pure water. The applicator device 8 is then filled with a concentrated aqueous solution of a detergent and the speed of travel of the hank or of the web is increased. Hereupon, the detergent is, on the one hand, distributed uniformly over the hank cross-section or web cross-section when the material passes through the centrifuging rollers 6, 5 and 4, whilst excess detergent is centrifuged off radially by the centrifugal action.

In a third phase, the applicator device 8 is again filled with pure rinsing water, and the excess detergent is rinsed out of the hank or the web. Finally, the hank or the web is allowed to run at increased speed of revolution, with the applicator device 8 completely empty, in order to pre-dry the hank or the web.

In a similar manner it is possible to apply not only dyestuff solutions or dispersions or detergent solutions but also other liquids or pastes which contain textile finishing agents, and to wash these off again entirely or partially. Plasticisers, creaseproof finishes and antistatic substances may be mentioned here as merely some of the numerous possibilities. In all these cases, the treatment of the hank or web material is very gentle since no squeezing pressure is exerted on it and nevertheless an effect can be achieved which is directly comparable with the results of the conventional padder.

According to a variant of the process described, the centrifuging rollers 4, 5 and 6 are not driven but are entrained by the hank (or the web) S, which in turn is drawn through the device by the drive roller.

To avoid misunderstandings it should here be pointed out expressly that the term "textiles," as used in the present context, not only comprises all yarns, woven and knitted goods and bonded textile fibre products, but in particular also carpets.

Two examples to illustrate the mode of action of the new equipment are described below.

EXAMPLE 1

In order to wash a disperse dyestuff which has been printed on, an equipment with three centrifuging rollers was used, the circumferential speed of which was about 3% above that of the drive so that the hank was not stretched when travelling rapidly through the centrifuging rollers. The textile product to be washed consisted of 85% of secondary acetate and 15% of Perlon, and had an average weight of 115 g per running meter. 900 m of cloth were introduced, at a linear speed of 170 m/minute, into an equipment of 5,000 liters capacity. The cloth was subjected to the following treatment:

Using a charge of 1,500 liters of cold water, the cloth was drawn through the equipment at full speed for 15 minutes.

During a further 15 minutes, the charge consisted of 1,500 liters of water and a detergent (temperature 50° C).

This was followed by a rinsing process, again lasting 15 minutes, with 1,500 liters of cold water.

When using a conventional winch beck a total charge of 4,500 to 5,000 liters of water would have been necessary in each of the three stages, each stage would have required at least twice the time and in spite of doubling the duration of treatment lower fastness of the product would have been achieved.

EXAMPLE 2

In order to dye a knitted fabric of texturised polyester, an equipment fitted with three centrifuging rollers was used and again the circumferential speed of the centrifuging rollers was chosen to be 3% above that of the drive to avoid stretching the hank. The 3 power variable speed motor made it possible to achieve a linear speed of travel through the equipment of 175 m/minute.

In this case it was possible to ascertain that optimum results, that is to say uniform distribution of the dyestuff paste in the textile hank, are achieved above all when the linear speed of the hank in m/minute numerically corresponds to at least three times the length of the hank, in m, present in the equipment. If, for example, the hank length is 50 m, the linear drive speed should be at least 150 m/minute.

In order to dye a Rachelle knitted fabric of texturised polyester of average weight 240 g/m$^2$, the following treatment was carried out:

1. Heat-setting of the opened knitted fabric
2. Introducing the dry knitted fabric
3. Use of a dyestuff paste which is comparable to a printing paste and contains the normally prescribed percentage of dyestuff. A 10% dyestuff concentration, based on the weight of the knitted fabric, has proved of value.
4. The dyestuff is introduced, at a dilution of 1 to 1.5, into the equipment. Thereafter, the equipment is closed and put into operation at maximum speed of rotation. During operation, the temperature is gradually raised to 100° C over the course of one hour by introducing steam.
5. On reaching the temperature of 110° C, the speed of rotation is reduced to about one-third, so that the knitted fabric remains smooth when reaching the temperature required for heat-setting. The temperature is now raised to 130° C through further admission of steam and the operation is maintained at this temperature for 20 minutes.
6. The pressure prevailing in the closed equipment is released down to atmospheric pressure, after which a washing process composed in accordance with Example 1 is carried out.

The equipment described with the aid of the drawing can be modified in numerous respects by those skilled in the art.

Thus, for example, it is not neccessary to give the centrifuging rollers 4, 5 and 6 instead these could also be entrained by the hank S.

Since the hank S, when passing from one centrifuging roller to the other, is intended to relax somewhat and as far as possible also to change its orientation (angular position of the external parts relative to the axis of the hank), the distance a between two adjacent centrifuging rollers is of importance. This distance a should therefore never be zero and should preferably correspond to at least the sum of the two centrifuging roller diameters involved. In that case, the textile structure in hank form has a possibility of stretching somewhat between two centrifuging rollers, during which the folds also shift in position.

In order to avoid any misunderstanding it must be emphasized that the main object of the present invention is not the dehydration of the hank S, but the uniform and rapid distribution of dyestuff paste with an estremely small quantity of liquid in the dyebath. The above described process not only uses the centrifugal effect of the roller motion, but during the passage of the hank S over the rollers the dyestuff continuously is deplaced from one hank to the other. As furthermore the relative positions of adjacent hank folds is continuously changing, the dyestuff is uniformly distributed over the whole width of the hank material, the consumption of dyestuff bath liquid being extremely low and the uniform distribution of the dyestuff being achieved in a very short time period.

I claim:

1. Equipment for repeatedly treating textiles in the form of discrete hanks or webs comprising a housing, at least one drive member of oval cross-section mounted for rotation within said housing to convey said hank or web downwardly in a serpentine movement, drive means for rotating said drive member, a liquid or paste applicator device in said housing, guide means positioned to receive said downwardly conveyed hank or web and to guide said received hank or web relative to said applicator for the application of said liquid or paste to said hank or web, at least two centrifugingelements positioned in said housing to receive said hank or web after application of said liquid or paste and to return said hank or web to said drive member, wherein the wrap-round angle of the hank or web on each centrifuging element is at least 90°, and means to rotate said centrifuging elements at different circumferential speeds respectively, thereby to evenly distribute the liquid or paste, applied to the hank or web, throughout the hank or web in cross-section, in the wrap-round zone of the centrifuging elements, under the influence of the pressure on the centrifuging elements and the centrifugal force generated by these, and to centrifuge off the excess liquid or paste.

2. Equipment according to claim 1 wherein the housing is a pressure-tight housing adapted for connection to a source of steam.

3. Equipment according to claim 2 wherein said means to rotate said centrifuging elements includes transmission means common to all said centrifuging elements thereby to prevent independent rotation of these elements.

4. Equipment according to claim 3 wherein said centrifuging elements are cylindrical rollers, the diameters of which decrease in the direction of travel of said hank or web.

5. Equipment according to claim 4 wherein the centrifuging elements have a circumference and said means to rotate said centrifuging elements is adapted to drive said centrifuging elements at an average circumferential speed of at least $3L/n$ (meters per minutes), where L is the length of the hank or web in meters and $n$ is the number of centrifuging elements.

6. Equipment according to claim 5 wherein said centrifuging elements are connected to said means to rotate said centrifuging elements by way of an interchangeable coaxial drive member.

* * * * *